US007025712B2

(12) United States Patent
Parrilla

(10) Patent No.: US 7,025,712 B2
(45) Date of Patent: Apr. 11, 2006

(54) SUSPENDED SQUAT RACK

(76) Inventor: Marco Parrilla, 1941 E. 34th St., Lorain, OH (US) 44055

( * ) Notice: Subject to any disclaimer, the term of this patent is extended or adjusted under 35 U.S.C. 154(b) by 500 days.

(21) Appl. No.: 10/235,868

(22) Filed: Sep. 5, 2002

(65) Prior Publication Data

US 2004/0048723 A1 Mar. 11, 2004

(51) Int. Cl.
*A63B 21/078* (2006.01)
*A63B 21/06* (2006.01)

(52) U.S. Cl. ..... 482/104; 482/94

(58) Field of Classification Search ..... 482/94–96, 482/104, 142, 148, 133; 248/58, 201, 301, 248/304, 339, 250; 211/60.1, 66
See application file for complete search history.

(56) References Cited

U.S. PATENT DOCUMENTS 3,848,786 A * 11/1974 Baxter ..... 224/546
4,262,901 A * 4/1981 Faust ..... 482/104
5,791,610 A * 8/1998 Sanchez ..... 248/176.1
6,557,807 B1 * 5/2003 Belanger ..... 248/215
6,565,048 B1 * 5/2003 Meyer ..... 248/58
6,715,728 B1 * 4/2004 Nielsen ..... 248/339
6,719,247 B1 * 4/2004 Botting ..... 248/60

* cited by examiner

*Primary Examiner*—Stephen K. Cronin
*Assistant Examiner*—Fenn C. Mathew
(74) *Attorney, Agent, or Firm*—Sand & Sebolt

(57) ABSTRACT

A squat rack squat rack which is mountable to an overhead support beam between respective walls above a floor of a room for a person to perform squat-type exercises. The squat rack includes a pair of barbell support frames each having a frame mount and a cradle adapted to retain one end portion of the lifting bar. Each support frame is comprised of a plurality of plate members, the cradle comprising a J-shaped member having an upper end portion, a lower hook, and a central portion disposed therebetween. The J-shaped member adjustably connects to a generally vertically-disposed surface of the frame mount at a plurality of vertical positions to facilitate use by persons of different heights. The suspended squat rack further includes a pair of mounting assemblies each comprising a clamp adapted to attach to a horizontally disposed flange which extends from a web of the overhead support beam. The clamps vertically secure the frame mount of one of the support frames to the support beam such that the cradle is disposed in parallel relation below the beam to support the barbells at generally shoulder height of the person for performing the squat-type exercises.

13 Claims, 8 Drawing Sheets

SUSPENDED SQUAT RACK

BACKGROUND OF THE INVENTION

1. Technical Field

Generally, the invention relates to exercise devices for performing squat type exercises with barbells, more particularly, the invention relates to a barbell support which extends adjacent the user's shoulders for supporting the barbell. Specifically, the invention relates to a suspended squat rack for supporting barbells of the type having an elongate lifting bar having a middle portion and respective end portions for supporting a plurality of disk weights.

2. Background Information

Squatting exercises are performed by athletes to build up and strengthen their leg muscles. Squats are typically performed by supporting free weights in the form of a barbell and disk weights, the barbell being disposed across the lifter's shoulders and gradually descending from a standing position to a squatting position. During squats the back of the lifter does not remain straight as the lifter descends, but rather the angle of the back off of vertical increases as the lifter descends.

Various exercise equipment have been devised to facilitate squatting exercises, the most common being a basic upright frame having a ground contacting base with a pair of upright members spaced a distance to support opposite end portions of the barbell on U-shaped barbell cradles at respective upper free ends thereof. The lifter places the barbell on the cradles and adds the desired disk weights to each end of the barbell. The weights are secured to the barbell against respective radial flanges using a pair of collars. The cradles and supported barbell with weights are disposed at a height which is approximately shoulder level for the average lifter. Some such exercise equipment have multiple pairs of cradles disposed at various heights or telescoping upright members permit adjustment to fit the particular shoulder height of various lifters. Although such exercise equipment are adequate for the purpose for which they were intended, they take up valuable floor space, and are relatively expensive to buy.

Another problem encountered with such exercise equipment is that it is not easily portable. While this might not be a problem for health clubs and other gyms which use such equipment, it is typically undesirable for home gyms. While interest in exercise has expanded over the years, many members of the public have found that belonging to a health club is too expensive and time consuming due to commute time, such that the demand has developed for smaller less expensive apparatus that may be placed in the home. However, use of exercise equipment in the home poses a serious space problem for many potential owners of home gyms. Because such equipment must be quite sturdy and durable to support heavy weights and high forces required by lifters, such exercise equipment is usually very heavy and must be fixed to the floor. Hence, present exercise equipment is not very maneuverable, and is, therefore, not well suited for residential or non-institutional uses.

An example of such exercise equipment particularly designed for squatting exercises is the barbell storage and exercise rack disclosed in U.S. Pat. No. 4,306,715 issued to Sutherland on Dec. 22, 1981. The exercise rack includes a pair of cradles in which the barbells are laterally received and supported in a stored position. The cradles are adjustable in height to permit the lifter to remove and replace the barbells from a comfortable standing position. The exercise rack further includes a pair of safety side rails which are spaced apart a distance sufficient to permit the user to stand between the rails to perform squatting and other weight lifting exercises. The side rails are also adjustable in height so as to be disposed slightly below the lowest position assumed by the barbells during the squats to prevent the barbells from inadvertently falling on the lifter if the weight slips or becomes too heavy to lift as exercise is conducted. The exercise rack takes up significant floor space, is likely relatively expensive to buy, and is that it is not easily portable.

Another example is disclosed in U.S. Pat. No. 5,411,458 issued to Giust on May 2, 1995 comprising an angled track squat exercise apparatus. The exercise apparatus includes a horizontally disposed base frame which supports at opposite ends a vertically disposed foot plate frame and a weight rack frame carrying a plurality of weights. A track frame is supported on the base frame between the foot plate frame and the weight rack frame and includes a horizontal section and a section which is downwardly inclined from the horizontal section. A carriage is supported on the track frame which is firstly displaced upwardly along the inclined section, then horizontally along the horizontal section by the legs and feet of the lifter pushing against the foot plate frame. Selected of the weights are lifted in the weight rack as the carriage displaced by the lifter. The exercise apparatus takes up significant floor space, is likely relatively expensive to buy, and is that it is not easily portable.

Therefore, the need exists for an improved exercise equipment particularly designed for squatting exercises which takes up little or no floor space, is inexpensive to buy, and is that it is easily portable.

SUMMARY OF THE INVENTION

Objectives of the invention include providing an overhead squat rack for performing squat type exercises which is suspended from an overhead support beam rather than resting on a floor surface.

Another objective is to provide an overhead squat rack which easily mounts to the support beam using standard tools.

A further objective is to provide an overhead squat rack which may be permanently mounted in an operative position for use with barbells or which may be slidably mounted for easy moving along the support beam between the operative position for use with barbells and a stowed position adjacent a wall conveniently out of the way.

A further objective is to provide an overhead squat rack in which the position of respective barbell support hooks may be vertically adjusted to suit users of various heights.

Still another objective is to provide an overhead squat rack which is inexpensively manufacturable, being fabricated from stock metal bar materials.

Another objective is to provide an overhead squat rack which is of light weight and compact size for easy shipping, installation, and storage.

A further objective is to provide such an overhead squat rack in which the barbell support hooks are retained from falling free during adjustment of height to prevent injury to the user.

A still further objective of the invention is to provide such a suspended squat rack which is easy to use, safe, and which solves problems and satisfies needs existing in the art.

These objectives and advantages are obtained by the improved suspended squat rack of the present invention for supporting barbells of the type having an elongate lifting bar having a middle portion and respective end portions for supporting a plurality of disk weights using respective collars, the suspended squat rack being mountable to an overhead support beam between respective walls above a floor of a room for a person to perform squat-type exercises, the general nature of which may be stated as comprising: a pair of barbell support frames each having a frame mount and a cradle adapted to retain one end portion of the lifting bar; and a pair of mounting assemblies each adapted for vertically securing said frame mount of one of said support frames to the support beam such that said cradle is disposed in parallel relation below the beam to support the barbells at generally shoulder height of the person for performing the squat-type exercises. The cradle preferably adjustably connects to the frame mount at a plurality of vertical positions to facilitate use by persons of different heights. The mounting assemblies preferably comprise clamps which are adapted to attached to a horizontally disposed flange which extends from a web of the overhead support beam, the clamps preferably being movable to fit flanges of differing widths.

A preferred embodiment of the suspended squat rack includes a pair of barbell support frames each having a frame mount and a cradle adapted to retain one end portion of the lifting bar. Each support frame is comprised of a plurality of plate members, the cradle comprising a J-shaped member having an upper end portion, a lower hook, and a central portion disposed therebetween. The J-shaped member adjustably connects to a generally vertically-disposed surface of the frame mount at a plurality of vertical positions to facilitate use by persons of different heights. The J-member is slidably connected to the mounting portion, being retained in the vertical positions by at least one pin member which extends through respective mating alignment holes through the J-shaped member and the frame mount. The suspended squat rack further includes a pair of mounting assemblies each comprising a clamp adapted to attached to a horizontally disposed flange which extends from a web of the overhead support beam. The clamps vertically secure the frame mount of one of the support frames to the support beam such that the cradle is disposed in parallel relation below the beam to support the barbells at generally shoulder height of the person for performing the squat-type exercises.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
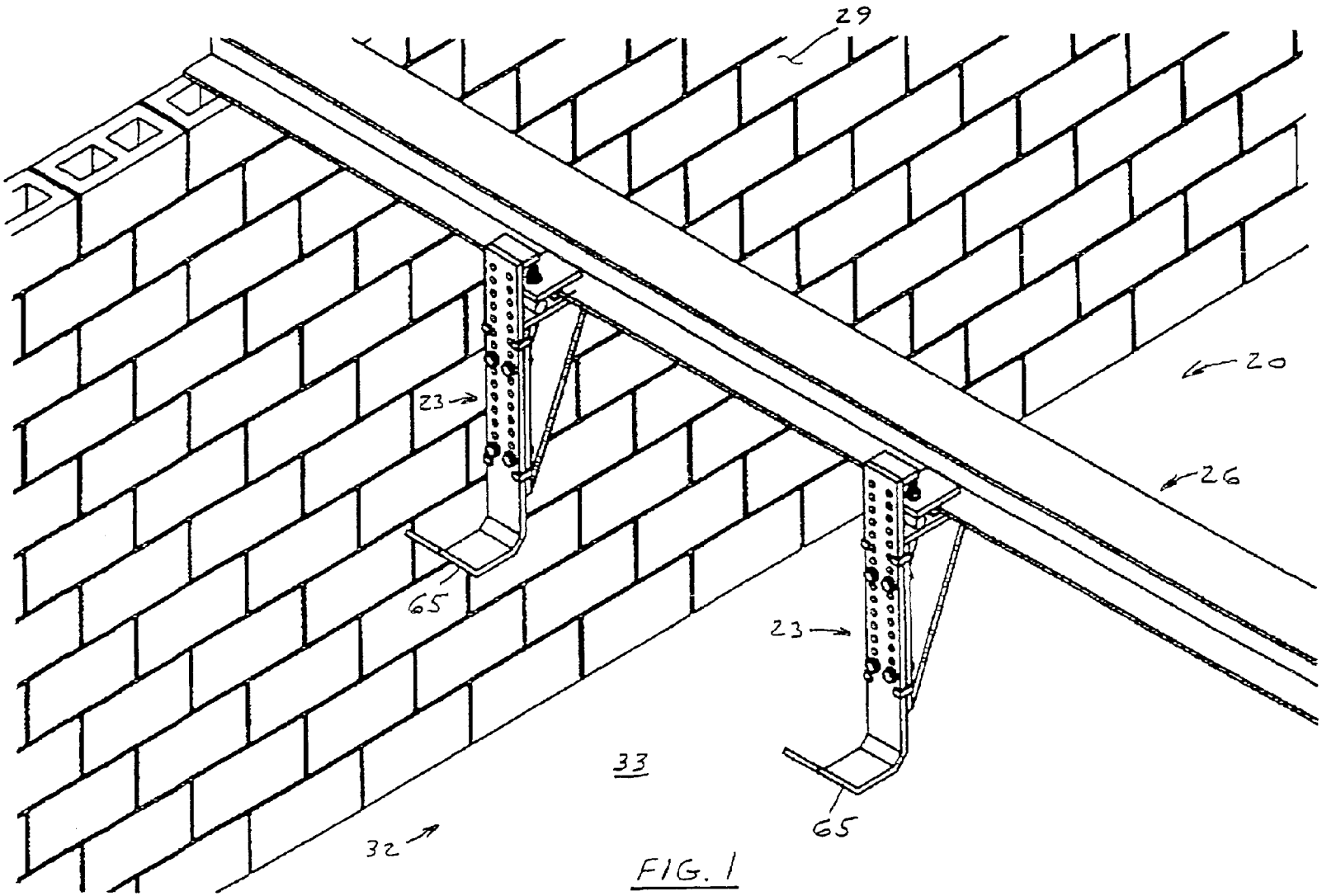
FIG. 1 is a perspective view of the suspended squat rack of the present invention disposed in an operational position comprising a pair of identical adjustable length barbell support assemblies slidably mounted to an overhead support I-beam extending from atop respective walls in a basement room.

The suspended squat rack of the present invention is shown in FIG. 1, and is indicated generally at 20. The squat rack 20 is of adjustable height, comprising a pair of adjustable length barbell support assemblies 23 which slidably mount to an overhead support I-beam 26 extending from atop a block wall 29 in a basement room 32 above a floor 33.

Figure 2:
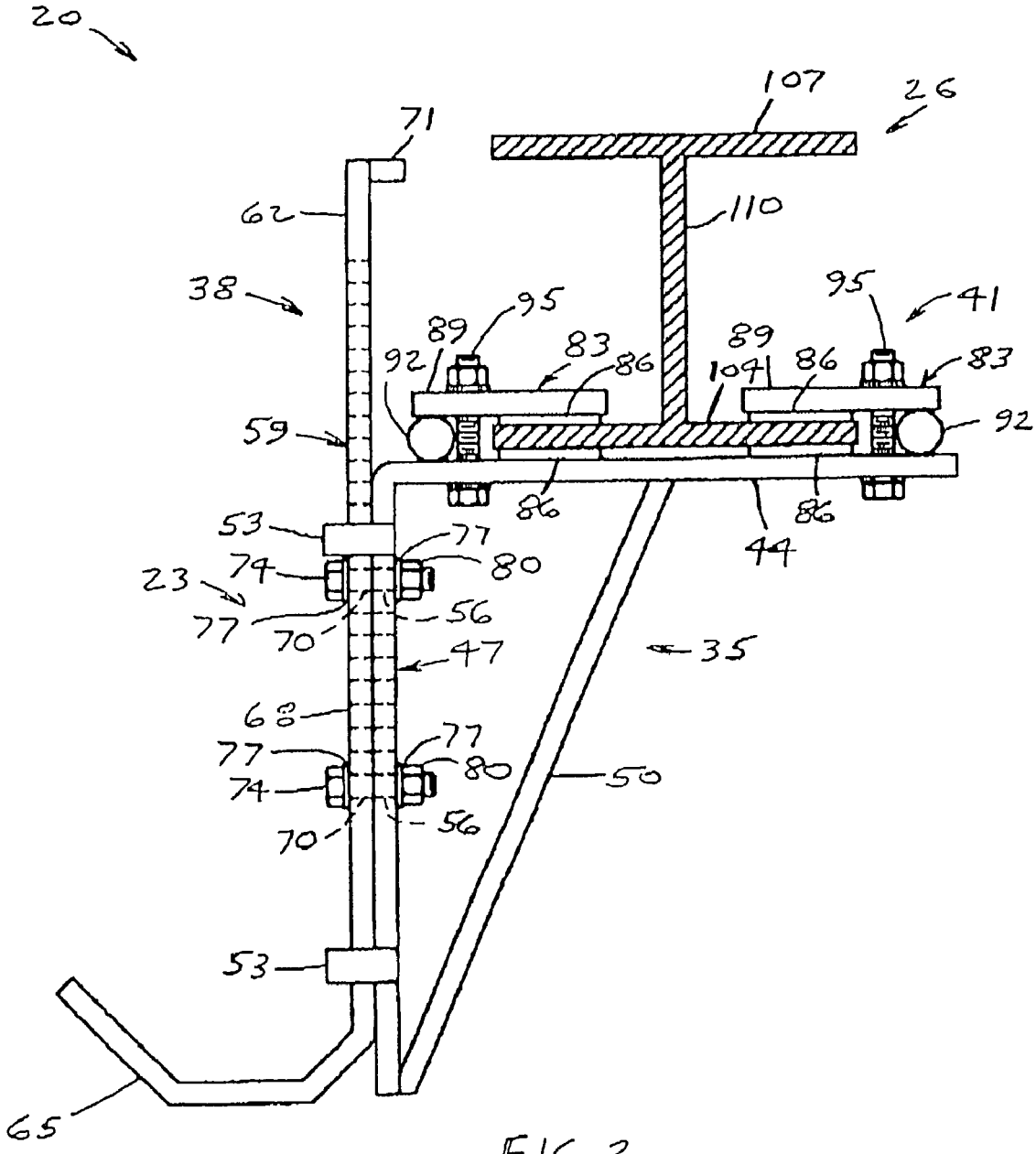
FIG. 2 is a side elevational view of the suspended squat rack of FIG. 1 with the I-beam shown in cross-section.
Figure 3:
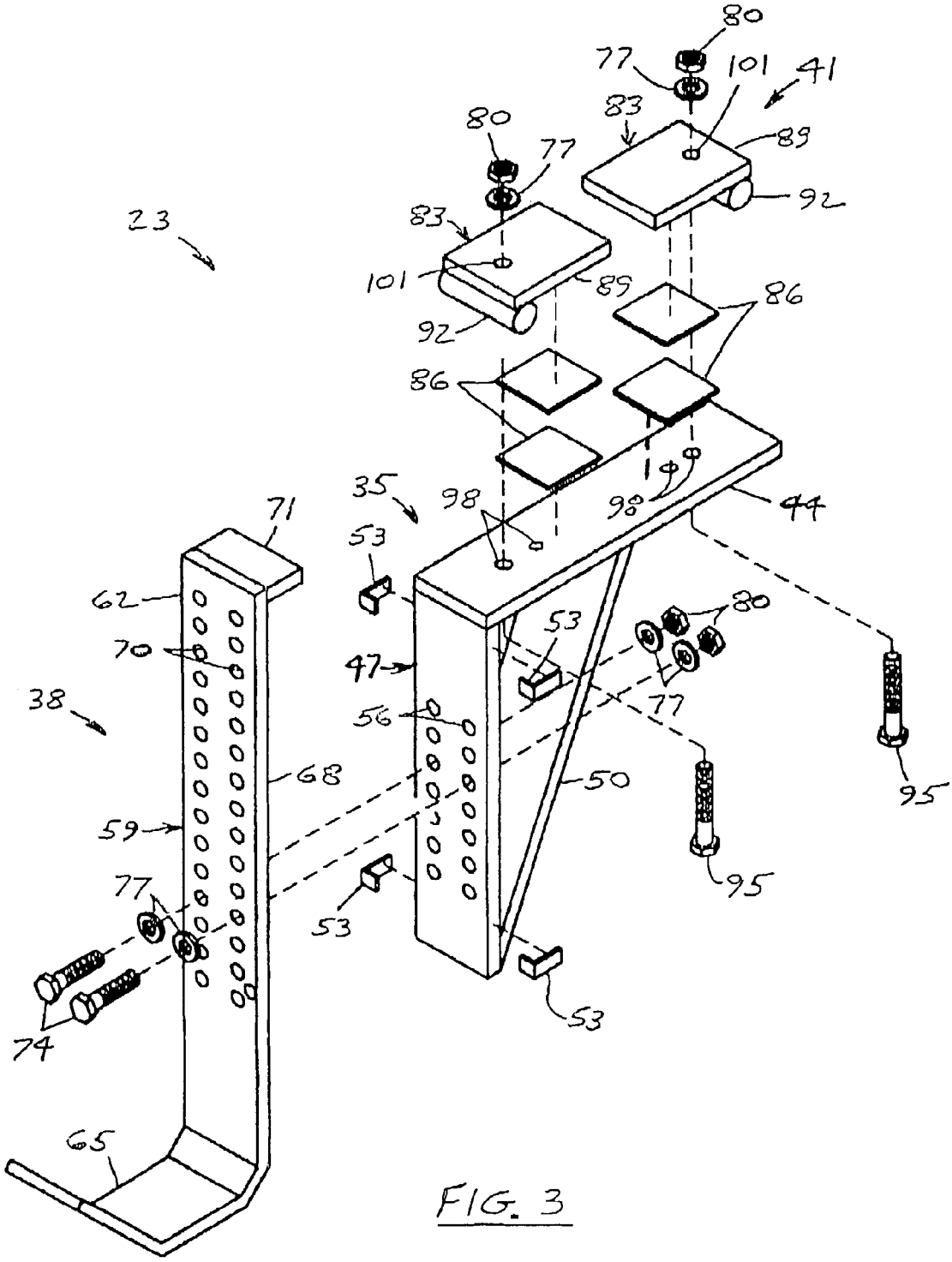
FIG. 3 is an exploded perspective view of one barbell support assembly of the suspended squat rack of FIG. 1 showing the component parts and hardware.
Figure 4:
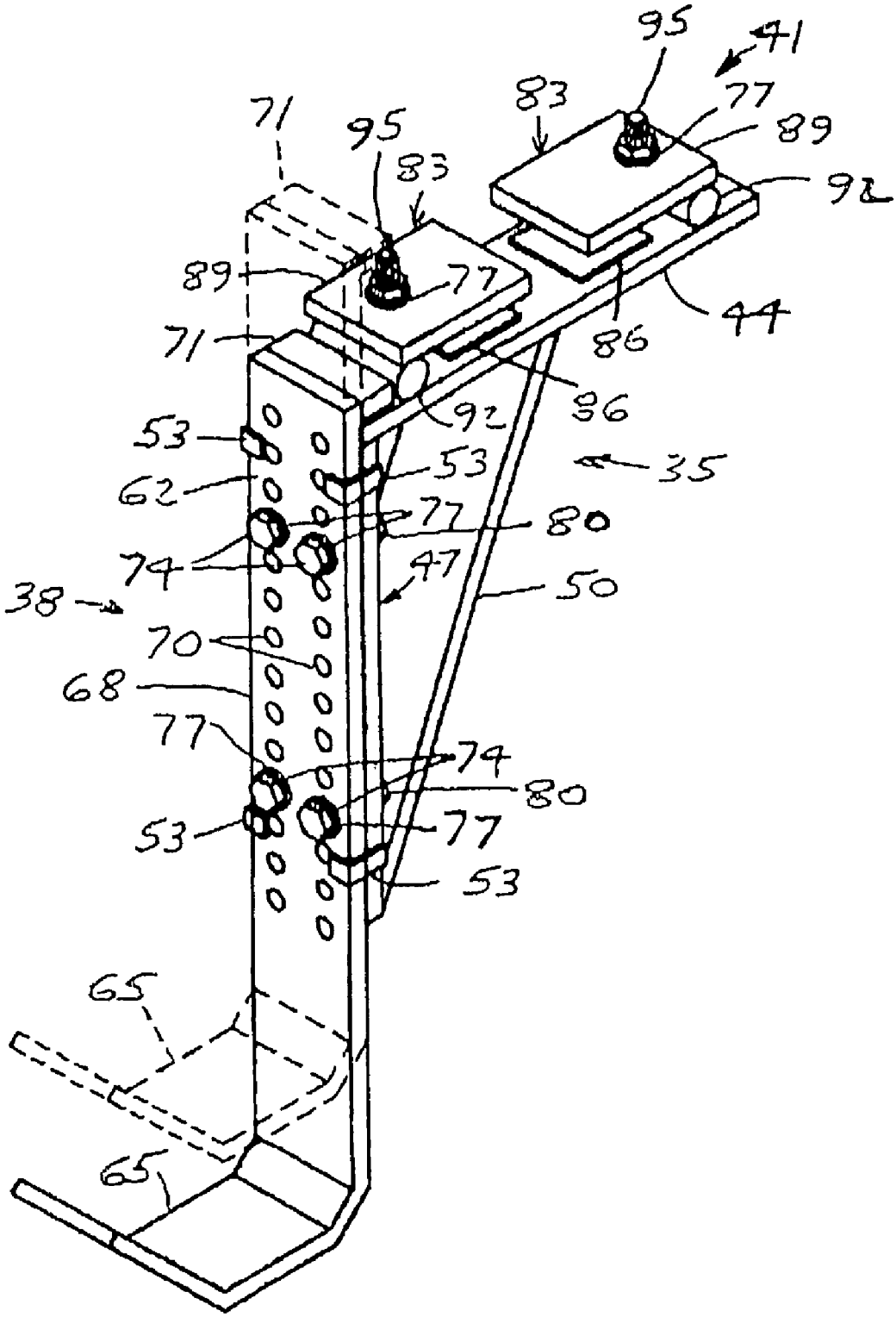
FIG. 4 is a side elevational view of one barbell support assembly of the suspended squat rack of FIG. 1 showing the vertical adjustability of the barbell support assemblies to adapt to various height I-beams and persons.

As best shown in FIGS. 2–4, each support assembly 23 includes a triangular support frame 35, a J-bar 38, and an I-beam mounting assembly 41. The support frame 35 includes a horizontal plate 44, a vertical plate 47, an angled brace plate member 50, and a plurality of L-shaped alignment brackets 53. The horizontal plate 44 and the vertical plate 47 are preferably integrally formed as shown. A plurality of adjustment holes 56 extend through vertical plate 47. The J-bar 38 includes a J-shaped plate 59 having an upper end 62, a lower hook 65, and a central portion 68 disposed therebetween having a plurality of adjustment holes 70 therethrough which are spaced to correspond with adjustment holes 56 of the vertical plate 47. A limiting plate 71 extends perpendicularly from upper end 62. The J-bar 38 adjustably connects to the support frame 35 being slidably retained thereto by the alignment brackets 53 and vertically retained in a desired position by a plurality of bolts 74, washers 77, and nuts 80.

I-beam mounting assembly 41 comprises a pair of clamps 83 and a plurality of self-adhesive plastic anti-friction pads 86. The clamps 83 each include a plate member 89 and a spacer in the form of a round rod 92 affixed thereto. The clamps 83 mount to the support frame 35 using a pair of bolts 95 which extend through two of a plurality of holes 98 through horizontal plate member 44 and holes 101 through plate members 89, being secured using the washers 77 and nuts 80. The anti-friction pads 86 are adhesively affixed to the horizontal plate 44 and the plate members 89. The support assemblies 23 slidably attach to a lower flange 104 of I-beam 26, which also includes an upper flange 107, and a web 110. The bolts 74 and nuts 80 are lightly tightened against rod 92, anti-friction pads 86, and lower flange 104 so as to be slidable along lower flange 104. The particular holes 98 used depends on the width of lower flange 107. The diameter of rod 92 is generally equal to the combined thickness of anti-friction pads 86 and lower flange 104 to facilitate sliding along I-beam 26 by positioning plate member 89 and anti-friction pads 86 parallel to lower flange 104.

Figure 5:
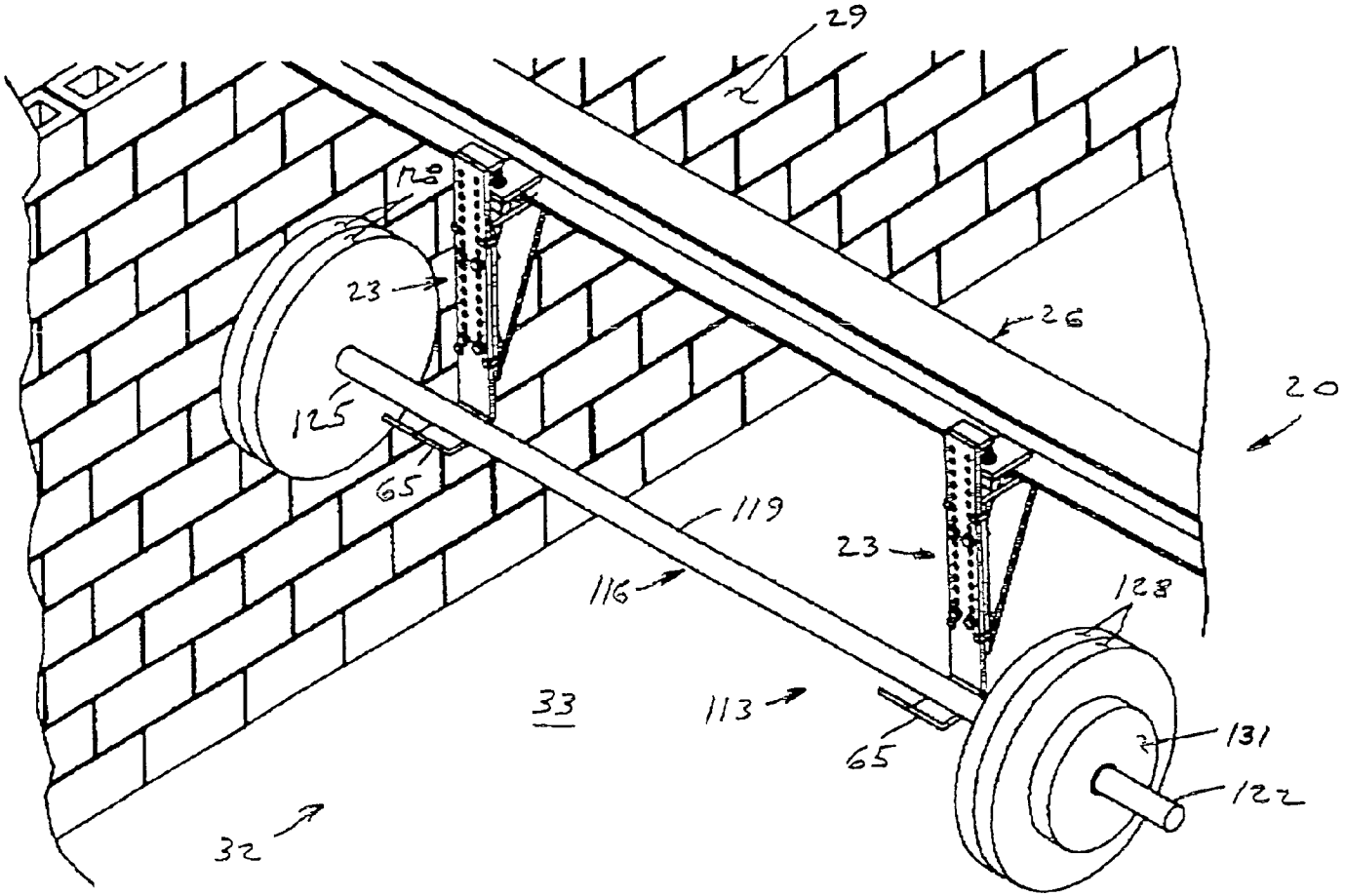
FIG. 5 is a perspective view of the suspended squat rack of FIG. 1 disposed in the operational position with the barbell support assemblies holding a barbell.
Figure 6:
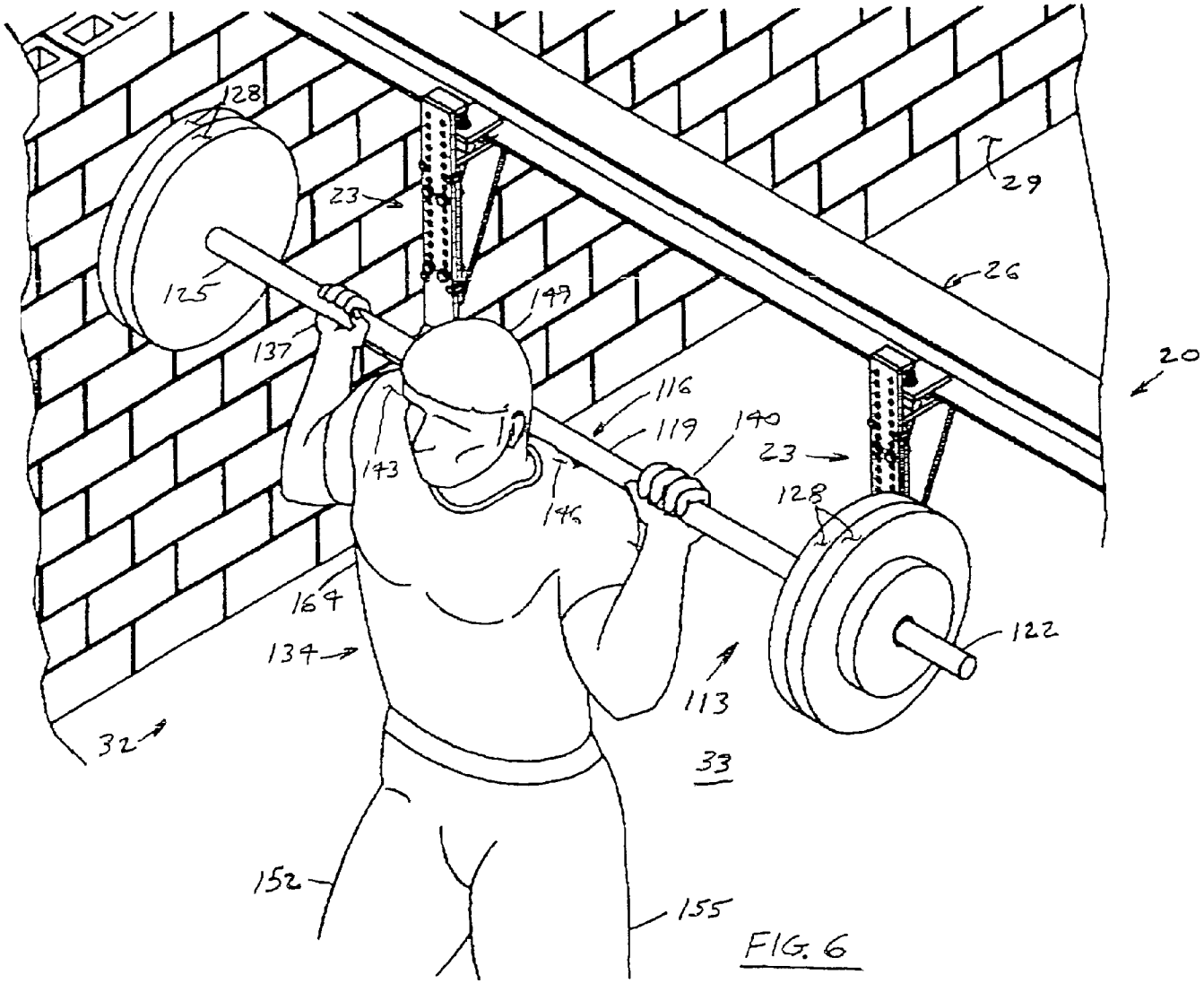
FIG. 6 is a perspective view of the suspended squat rack of FIG. 1 disposed in the operational position with the barbell lifted from the barbell support assemblies by a person positioned to do squats.
Figure 7:
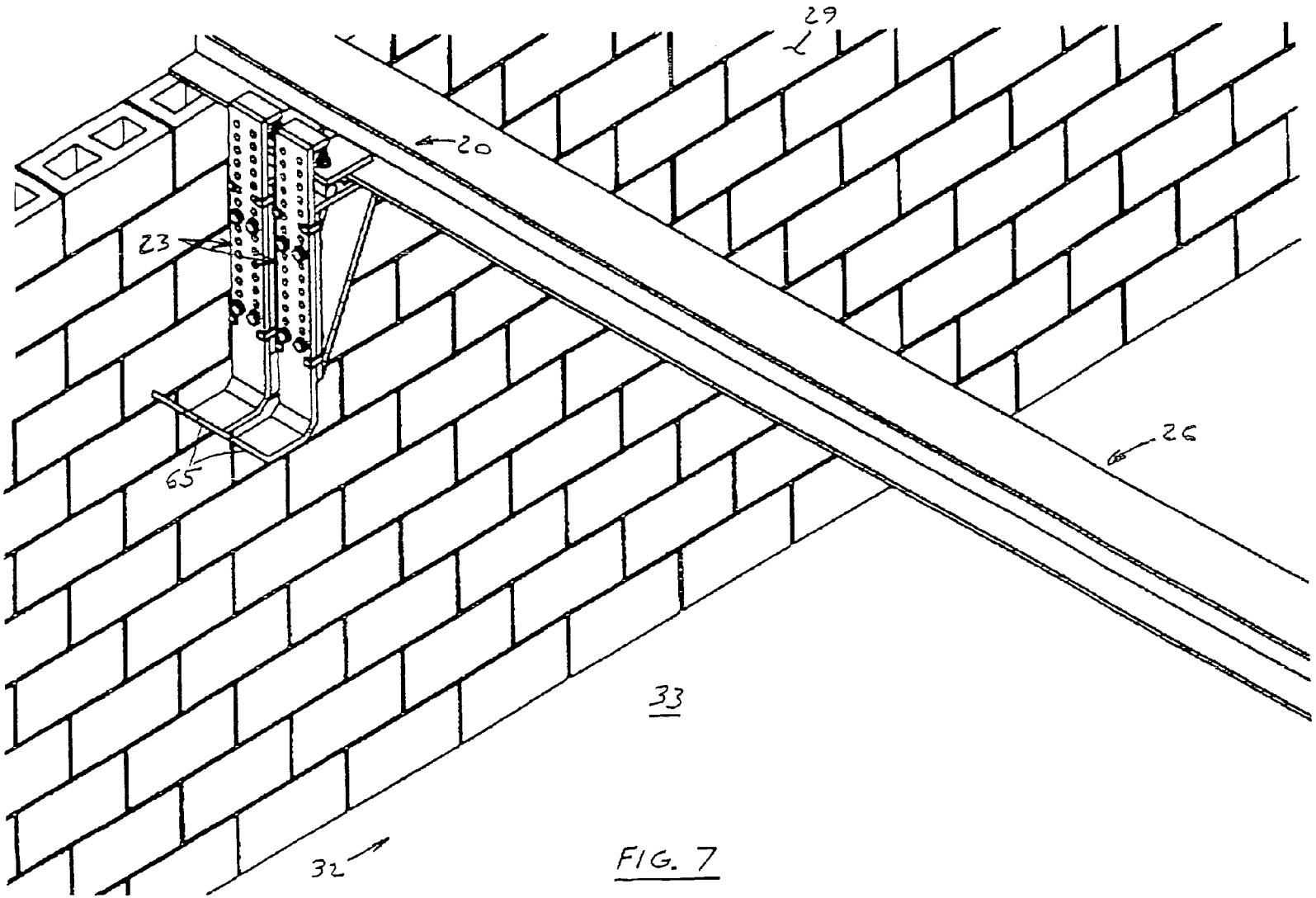
FIG. 7 is a perspective view of the suspended squat rack of FIG. 1 disposed in a stowed position with the barbell support assemblies slid along the I-beam to adjacent the wall.

The suspended squat rack 20 is used as shown in FIGS. 5 and 6 in an operative position for use with barbells 113 which includes an elongate lifting bar 116 having a middle portion 119 and respective end portions 122 and 125. A plurality of large disk weights 128 and small disk weights 131 are attached to barbells 113 using standard retaining collars (not shown). The end portions 122 and 125 of barbells 113 are supported by lower hooks 65 of J-bars 38. The lateral distance between the support assemblies 23 may be adjusted prior to use by sliding them along the lower flange 104 of I-beam 26 to suit the particular person 134 and barbells 113. The height of the support assemblies 23 may be adjusted by loosening nuts 80, removing bolts 74 from adjustment holes 56 and 70, repositioning J-bar 38 along support frame 35 with the lower hook 65 at the desired height relative to floor 33, inserting bolts 74 through the appropriate adjustment holes 56 and 70, and securing using nuts 80. Washers 77 are removed and replaced as shown. The J-bar 38 is slidably retained by the alignment brackets 53 and vertically retained from inadvertently falling free of the support frame 35 during removal of bolts 74 by the limiting plate 71 contacting the junction of the horizontal and vertical plates 44 and 47. A person 134 desirous of lifting the barbell grips the end portions 122 and 125 in hands 137 and 140 and lifts the middle portion 119 onto his or her shoulders 143 and 146 behind their head 149. Squats are performed by the person 134 in the standard manner by bending his or her legs 152 and 155 at the knees 158 and 161 and lowering the upper body 164 while keeping in an upright position. Upon completion of the desired number of squats, the person 134 replaces the end portions 122 and 125 of barbells 113 on the lower hooks 65. The hooked configuration of the lower hooks 65 prevents barbells 113 from rolling therefrom. Following use, the support assemblies 23 may be moved along I-beam 26 to a stored position adjacent wall 29 for out-of-the-way storage by easily sliding on anti-friction pads 86 (FIG. 7).

Figure 8:
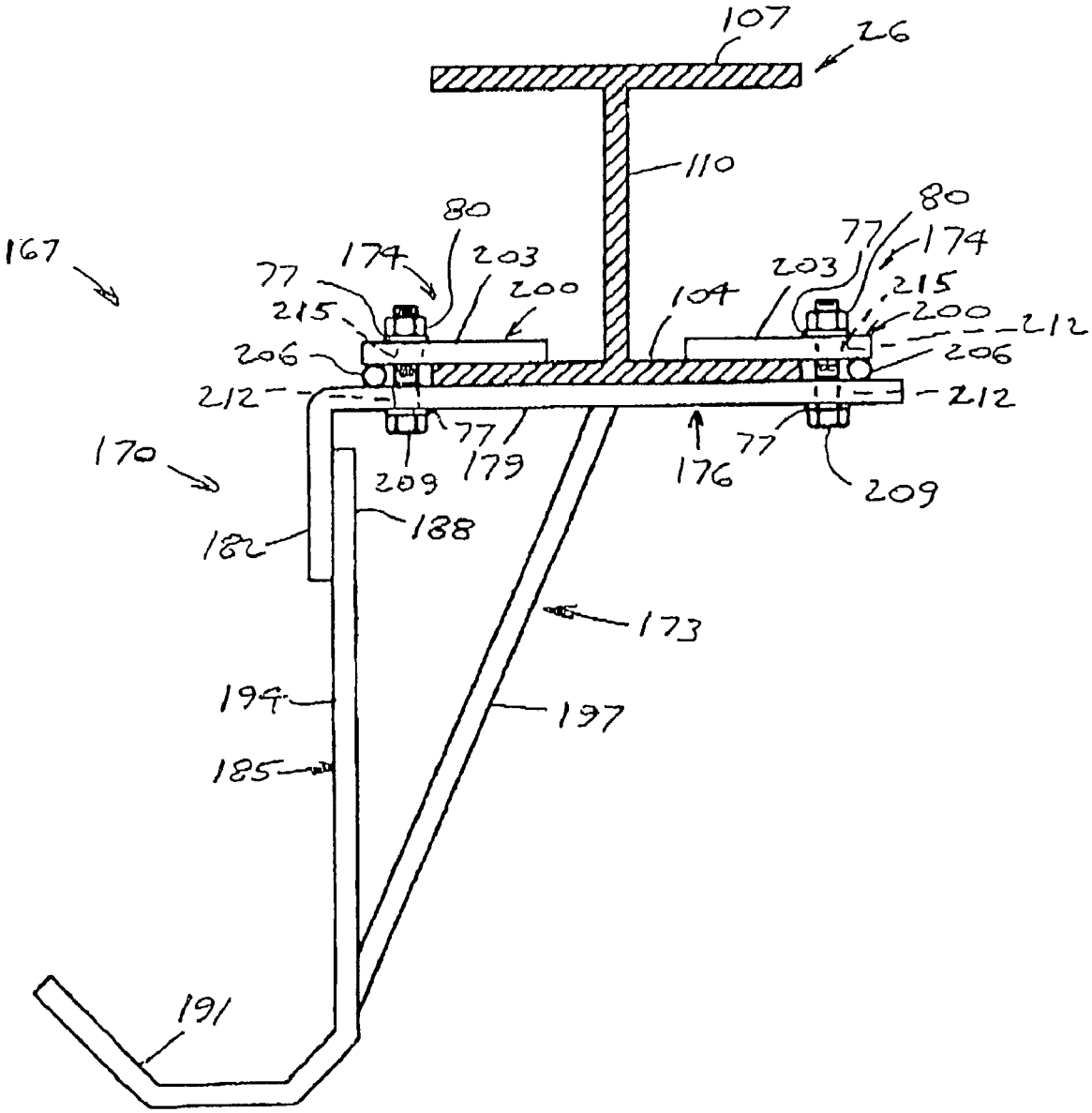
FIG. 8 is a side elevational view of a second embodiment of the suspended squat rack of the present invention comprising a pair of identical fixed length barbell support assemblies slidably mounted to the I-beam extending from atop the walls in the basement room.

A second embodiment of the suspended squat rack of the present invention is shown in FIG. 8, and is indicated generally at 167. The squat rack 167 is of a fixed height, comprising a pair of fixed length barbell support assemblies 170 which fixedly mount to the overhead support I-beam 26 extending from atop the block wall 29 in the basement room 32 above the floor 33.

Each support assembly 170 includes a triangular J-bar support frame 173 and an I-beam mounting assembly 174. The support frame 173 includes an L-shaped plate member 176 having a horizontal plate 179 and a downwardly dependent tab 182, a J-shaped plate 185 having an upper end 188, a lower hook 191, and a central portion 194 disposed therebetween, and an angled brace plate member 197. The I-beam mounting assembly 174 comprises a pair of clamps 200. The clamps 200 each include a plate member 203 and a spacer in the form of a round rod 206 affixed thereto. The clamps 200 mount to the support frame 173 using a pair of bolts 209 which extend through respective holes 212 through horizontal plate 179 and holes 215 through plate members 203, being secured using the washers 77 and nuts 80. The clamps 83 of the I-beam mounting assembly 41 mount to the support frame 173 using a pair of the bolts 95 which extend through respective holes 200 through horizontal plate 179 and the holes 101 through plate members 89, being secured using the washers 77 and nuts 80. The support assemblies 170 fixedly attach to the lower flange 104 of the I-beam 26 by tightening the bolts 95 and nuts 80 against rod 206 and lower flange 104. The diameter of rod 206 is generally equal to or slightly less than the thickness of the lower flange 104 to facilitate fixedly clamping along I-beam 26. Alternately, the support assemblies 170 may use the I-beam mounting assemblies 41 so as to be slidable along I-beam 26. More than the two holes 179 may be provided to accommodate lower flanges 107 of varying widths. The suspended squat rack 167 is used to perform squatting exercises in a similar manner to suspended squat rack 20.

Many variations of the suspended squat rack of the present invention are possible while staying within the same inventive concept. For example, it is understood that other ways of providing height adjustment are possible such as telescoping tube assemblies. Likewise, while the embodiments shown use steel or aluminum bar stock which is bent and welded together, other materials such as plastic may be used with the design being appropriately modified to suite the particular material and manufacturing process.

Accordingly, the suspended squat rack takes up no significant floor space, is inexpensive to manufacture, and is that it is easily portable which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved squat rack is constructed and used, the characteristics of the construction, and the advantageous, new and useful results obtained; the new and useful structures, devices, elements, arrangements, parts and combinations, are set forth in the appended claims.

I claim:

1. A suspended squat rack for supporting barbells of the type having an elongate bar having a middle portion and respective end portions for supporting a plurality of disk weights, the suspended squat rack being mountable to an overhead support beam which includes a web and a flange, the suspended squat rack comprising:

a pair of support frames each having a frame mount and a cradle adapted to receive one end portion of the lifting bar; and a pair of clamps secured to each frame mount and adapted to secure the associated cradle to the support beam; and in which each clamp includes a plate which mount to a mounting plate of the frame mount, said clamps of each pair adapted to be disposed on opposite sides of the web of the support beam and adapted to clamp to the flange thereof and thereby longitudinally affix said support frame to the overhead support beam and in which each clamp further includes a spacer affixed thereto opposite the flange; the spacer being of a thickness approximate the same as the flange.

2. The suspended squat rack defined in claim 1 in which the spacer comprises a round rod.

3. The suspended squat rack defined in claim 2 which the clamps permit longitudinal sliding of the support frames along the flange to adjacent one of the walls for storing of said support frames when not being used.

4. The suspended squat rack defined in claim 3 which the clamps each include at least one anti-friction pad affixed to said plate and at least one anti-friction pad affixed to the frame mount to facilitate sliding of said support frames along the overhead support beam, and wherein said spacer is of a thickness about the same as the flange plus two anti-friction pads.

5. The suspended squat rack defined in claim 4 in which the clamps are movable to fit flanges of differing widths.

6. A suspended squat rack for supporting barbells of the type having an elongate bar having a middle portion and respective end portions for supporting a plurality of disk weights, the suspended squat rack being mountable to an overhead support beam, the suspended squat rack comprising:

a pair of support frames each comprising:

a frame mount comprised of a horizontal plate adapted to engage the overhead support beam, a vertical plate downwardly dependent therefrom and having a plurality of alignment holes therethrough, an angled brace which interconnects said horizontal plate and vertical plate; and which includes a plurality of L-shaped alignment brackets, a cradle adapted to receive one end portion of the lifting bar; the cradle comprising a J-shaped member having an upper end portion, a lower hook, and a central portion disposed therebetween and having a plurality of alignment holes therethrough which are spaced to correspond with the plurality of holes through the vertical plate, said J-shaped member being adjustably and removably connected to the vertical plate at one of a plurality of vertical positions to faciliate use by persons of different heights; the J-shaped member being slidably retained to the vertical plate by said alignment brackets, said J-shaped member being retained in the vertical positions by at least one fastener which extends through the respective mating alignment holes in the J-shaped member and frame mount; and wherein the J-shaped member further includes a limiting dog extending perpendicularly from the upper end portion of the J-shaped member to retain said J-shaped member from falling free from the frame mount when the fastener is loosened; and a clamp secured to each frame mount and adapted to secure the cradle to the support beam.

7. The suspended squat rack defined in claim 6, in which the cradle is affixed to the frame mount such that the support frames are of a fixed length.

8. The suspended squat rack defined in claim 6, wherein the overhead support beam has a web and flanges and in which each clamp includes a pair of plates which mount to a horizontal plate of the support frame using a bolt, said plates being adapted to be disposed on opposite sides of the web on the overhead support beam and adapted to clamp to one of the flanges to longitudinally affix said support frame to the overhead support beam.

9. A suspended squat rack for supporting barbells of the type having an elongate bar having a middle portion and respective end portions for supporting a plurality of disk weights, the suspended squat rack being mountable to an overhead support beam having a web and opposing flanges, the suspended squat rack comprising:

a pair of support frames each having a frame mount and a cradle adapted to receive one end portion of the lifting bar; and wherein the frame mount includes a generally vertically-disposed plate having a plurality of L-shaped alignment brackets extending outwardly and forwardly away therefrom; and wherein the cradle comprises a J-shaped member which includes an upper end portion having a front surface and a rear surface; a lower hook portion; and a central portion disposed therebetween, and wherein said J-shaped member is removably connected to the vertically-disposed plate of the frame mount; and wherein the J-shaped member further includes a limiting dog disposed on the upper end portion thereof; the limiting dog extending outwardly away from the J-shaped member in the opposite direction to the hook portion thereof; and wherein the alignment brackets keep the rear surface of the upper end portion of the cradle in abutting contact with the plate of the frame mount; and wherein the cradle adjustably connects to the frame mount at a plurality of vertical positions to facilitate use by persons of different heights.

a clamp secured to each frame mount adapted to secure the cradle to the support beam.

10. The suspended squat rack defined in claim 9 in which the clamps permit longitudinal sliding of the support frames along the flange to adjacent one of the walls for storing of said support frames when not being used.

11. A suspended squat rack for supporting barbells of the type having an elongate bar having a middle portion and respective end portions for supporting a plurality of disk weights, the suspended squat rack being mountable to an overhead support beam having a web and opposing flanges, the suspended squat rack comprising:

a pair of support frames each having a frame mount and a cradle adapted to receive one end portion of the lifting bar; and wherein the frame mount includes a generally vertically-disposed plate having a plurality of L-shaped alignment brackets extending outwardly and forwardly away therefrom; and wherein the cradle includes an upper end portion having a front surface and a rear surface; and wherein the alignment brackets keep the rear surface of the upper end portion of the cradle in abutting contact with the plate of the frame mount; and a clamp secured to each frame mount adapted to secure the cradle to the support beam; in which each clamp includes a pair of plates which mount to a horizontal plate of the support frame using a bolt, said plates being adapted to be disposed on opposite sides of the web on the overhead support beam and adapted to clamp to one of the flanges to longitudinally affix said support frame to the overhead support beam; and further comprising a spacer disposed intermediate each clamp plate and the horizontal plate, so that the clamp plates lie substantially parallel to the horizontal plate when the clamp member is secured to the flange of the support beam.

12. The suspended squat rack defined in claim 11, wherein the spacer is a round rod disposed proximate one end of each clamp plate.

13. The suspended squat rack defined in claim 12, further comprising a plurality of anti-friction pads secured to the clamp plates and to the horizontal plate of the frame mount, such that some of the anti-friction pads are disposed between the flange of the support beam and the clamp plates; and other of the anti-friction pads are disposed between the flange and the horizontal plate of the frame mount.

* * * * *